United States Patent [19]

Gardiner

[11] 4,116,762

[45] Sep. 26, 1978

[54] POROUS FELT WEB CONDITIONING SYSTEM

[76] Inventor: Frank J. Gardiner, 3 Ledge Rd., Cumberland Foreside, Me. 04011

[21] Appl. No.: 763,654

[22] Filed: Jan. 28, 1977

[51] Int. Cl.[2] ..... B08B 5/00; B08B 7/04; D21F 1/32

[52] U.S. Cl. ..... 162/199; 15/302; 15/306 A; 134/15; 134/30; 162/275; 162/360 DP

[58] Field of Search ..... 162/199, 274, 276, 360 DP, 162/207, 275; 134/15, 30; 15/302, 306 A; 34/16, 23, 122, 123; 29/121.3

[56] References Cited

U.S. PATENT DOCUMENTS

| | | | |
|---|---|---|---|
| 3,100,928 | 8/1963 | Bryand | 29/121.3 X |
| 3,279,977 | 10/1966 | Cirrito | 162/276 |
| 3,284,285 | 11/1966 | Holden | 162/207 X |
| 3,347,740 | 10/1967 | Goumeniouk | 162/199 |
| 3,564,686 | 2/1971 | Bryand | 29/121.3 |

*Primary Examiner*—Richard V. Fisher
*Attorney, Agent, or Firm*—Schiller & Pandiscio

[57] ABSTRACT

A felt conditioning system is disclosed for use in connection with paper-making apparatus wherein an endless belt of absorbent felt is pressed at a station along the path of belt motion, into contact with a paper sheet in order to de-water the latter. In accordance with the invention, the felt is purged of water and other foeign matter transferred thereto from the paper, by passing the belt around a hollow, foraminous conditioning roll at high speed. Air pressure controlled within selected limits is applied to a portion of the inside surface of the belt in contact with the roll. The combined action of centrifugal force, air pressure and gravity expels the water and foreign matter carried by the belt.

26 Claims, 2 Drawing Figures

POROUS FELT WEB CONDITIONING SYSTEM

Figure 1:
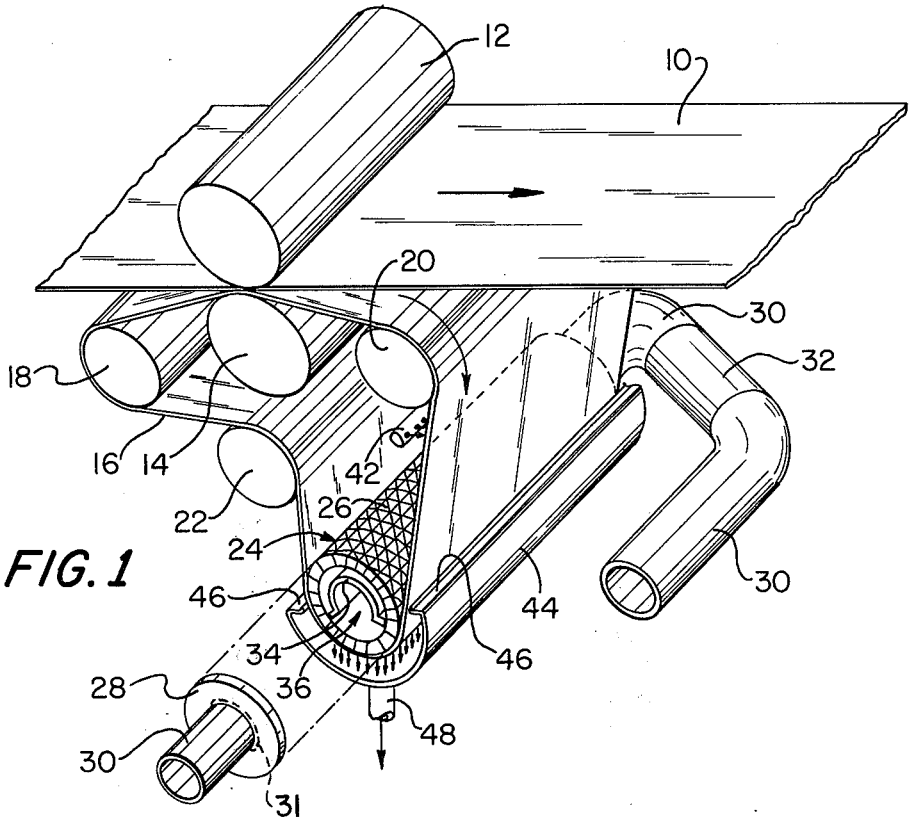

The present invention relates in general to new and improved felt conditioning systems, in particular to a system for removing water and particles of foreign matter transferred to an endless belt of absorbent felt during a portion of its path.

The process of paper-making involves a number of operations intended to remove water from a paper sheet which travels at relatively high speeds, in some instances at speeds on the order of 3,000 feet per minute. One of the paper de-watering steps involves the use of an endless belt of absorbent felt which is pressed into contact with the moving paper sheet to absorb the moisture carried by the latter.

To assure its continued utility, the endless belt, which moves at the speed of the paper, must be purged of the substances transferred to it from the paper. These substances consist primarily of large amounts of water squeezed out of the paper as well as particles, such as clay, chalk and loose fibers that are characteristically present in loose form at this point of the paper-making process.

In some felt conditioning systems of the prior art, the belt is passed over one or more slots in a chamber within which a vacuum is maintained to remove the water and water-borne particles carried by the belt. Vacuum pumps, particularly those capable of handling large quantities of liquid, are very expensive and add materially to the overall cost of the process of paper-making. Further, such pumps have relatively large power requirements and require constant maintenance to keep them in good working order. These factors raise the cost of the paper-making process and thereby tend to increase the price of the final product.

An additional disadvantage of the use of vacuum pumps resides in the fact that a relatively powerful vacuum is required in order to operate effectively. Hence there is a tendency for the belt to be drawn into the slot over which it passes and to be sharply bent as a vacuum is applied. Bending of the felt material produces extensive wear and weakness in the belt, all of which tends to shorten its life. Further, the application of vacuum inevitably increases the wear on the belt due to friction alone, as it is dragged across the vacuum slots. Such friction often results in bagging of the felt material and tends to destroy the uniformity of the belt surface.

Attempts have been made in the past to alleviate some of the foregoing disadvantages, particularly the wear due to belt bending, by narrowing the vacuum slots in the direction of belt travel. However, such modifications generally reduce the effectiveness of the de-watering operation since the inertia of the water in the belt prevents the vacuum from taking effect if it is applied for too short a period. Slowing down the belt speed is not an acceptable solution since it requires a corresponding slowdown of the speed of the paper sheet. Passing the belt over a large number of narrow slots also poses problems because it interposes additional lands where no purging of the belt-carried substances occurs as the belt passes over them. The latter scheme also serves to increase the number of areas where friction occurs.

Other systems of purging the belt material of foreign substances have taken the form of passing the belt at high speeds around a curved surface having a relatively small radius. Such a surface may be either stationary or freely rotatable. These techniques place primary reliance on the action of centrifugal force to remove the water content of the felt. The smaller the radius of the surface over which the belt passes, the greater will be the force acting to remove the water. In many of these devices the radius is so small, e.g. of the order of 2 inches, that belt damage due to bending may occur, in a manner similar to that which occurs when vacuum slots are employed. While the felt material may only have a thickness of ¼ inch, it may be as wide as 30 feet. When such a belt moves under tension around a small radius at speeds of 3,000 feet per minute, excessive belt wear, if not belt damage, are inevitable. Quite apart from the cost of replacing the special felt belt, the replacement procedure itself requires a shut down of the high-speed paper making system, usually with adverse results.

In other prior art devices, for example as shown in U.S. Pat. No. 3,279,977 to Cirrito et al, a freely rotating roll having peripheral grooves is employed and the belt is passed around the roll in contact with the latter. The action of centrifugal force is assisted by the application of pressurized air introduced through a manifold positioned to one side of the roll and blown at the inside surface of the belt through the aforesaid peripheral grooves.

De-watering systems such as that shown in the Cirrito patent have a number of disadvantages. Primary among these is the requirement for a relatively large air compressor. This is necessitated by the loss of air pressure between the compressor and the belt, due in part to the indirect manner in which the air is applied to the belt. Further, the angle at which water is expelled from the belt is centered on a horizontal line. Thus, the applied pressure must to some extent work against the weight of the water.

Since the belt is under tension, there will be a tendency for the grooves and ridges of the roll to be impressed on the belt. Since the same belt areas continue to contact the ridges on the roll, over a period of time the belt surface will become uneven and show signs of wear. Further, the portions of the belt in contact with the ridges are not subject to the action of the applied air pressure in the same manner as the belt portions overlying the grooves. Inevitably the ridge-contacting portions will retain more moisture than those overlying the grooves. Since the same belt areas continue to make contact with the ridges, the belt will be unevenly dewatered.

In another type of prior art belt conditioning system, as shown in U.S. Pat. No. 3,347,740 to Goumeniouk, a stationary tubular member is used which is formed with a plurality of holes distributed throughout a horizontally centered angle. Air introduced into the tube is blown out through the holes to assist the action of centrifugal force in expelling water. Although lower applied pressures are contemplated, the air pressure is preferably strong enought to lift the belt off the surface of the tubular member to cause it to ride on an air cushion. The occurrence of lift-off permits the radius of the curved surface to be decreased so as to enhance the action of centrifugal force in expelling the water.

The foregoing technique is inefficient for de-watering purposes since belt lift-off permits much of the air to escape without passing through the belt. Thus, the trade-off for providing an air cushion intended to prevent damage to the belt due to friction between the stationary tubular member and the belt, is a larger compressor due to the inherent inefficiency of such a technique. As an alternative, or as an additional safety measure, Goumeniouk also employs a "frictionless cover" over the tubular member to reduce belt damage. The cover has perforations which must register with the holes in the surface of the tubular member through which air is blown at the underside of the belt.

The type of conditioning system disclosed by the Goumeniouk patent may also use a rotating member in place of a stationary curved surface. However, here air is applied to the under surface of the belt as it approaches the curved surface and its application is not limited to the belt portion in contact with the latter surface. Thus, the pressurized air is applied over a larger area and hence a pump having greater capacity is required.

The types of conditioning devices for de-watering felt belts represented by the Cirrito and Goumeniouk patents fail to combine the efficient purging of foreign substances carried by the belt with gentle belt treatment. In such prior art devices even the construction of the curved surface itself often militates against uniform de-watering of the belt. Further, all such devices are dependent on the use of a curved surface having a very small radius in order to expel liquids, primarily by the use of centrifugal force. As stated above, for a belt which may have a thickness of ¼ inch and a width on the order of 30 feet, belt motion at 3,000 feet per minute through a small radius, e.g. a 2 inch radius, is likely to cause harm to the belt, particularly over a prolonged period of time. By their failure to limit the use of pressurized air to de-watering purposes and by failing to limit its application to the belt area of interest, such prior art devices also require additional compressor capacity.

Accordingly, it is a primary object of the present invention to provide belt-conditioning apparatus for removing water and particles from a belt, which apparatus is not subject to the foregoing disadvantages.

It is another object of the present invention to provide a simple, economical belt-conditioning system for a felt belt traveling at high speeds, which system is capable of gently handling the belt while purging it of foreign matter.

It is a further object of the present invention to provide an economical belt conditioning apparatus which is efficient in its use of pressurized air and which makes only modest demands on the compressor providing such air under pressure.

It is still another object of the present invention to provide belt conditioning apparatus wherein all portions of the belt are substantially uniformly de-watered.

Other objects of the present invention will in part be obvious and will in part appear hereinafter. The invention accordingly comprises the method comprising the several steps and the relation and order thereof, and the apparatus possessing the features, properties and relation of elements, all of which are exemplified in the following detailed disclosure and the scope of the application of which will be indicated in the claims.

Figure 2:
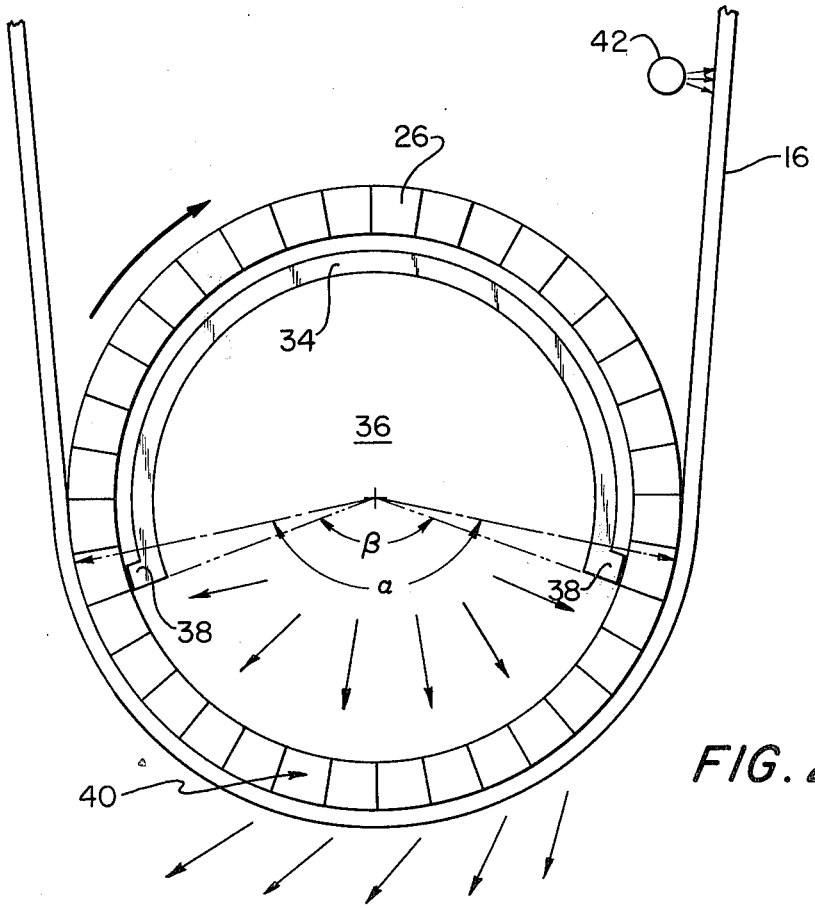

For a fuller understanding of the nature and objects of the present invention, reference should be had to the following detailed description taken in connection with the accompanying drawing wherein:

FIG. 1 is a schematic representation of the apparatus which forms the subject matter of the present invention; and FIG. 2 illustrates in greater detail certain features of the apparatus of FIG. 1.

With reference now to the drawing and in accordance with well-known art, an elongate sheet of paper 10 travelling in the direction of the arrow shown in FIG. 1, enters the nip between press roll 12 and suction press roll 14 positioned proximate the press roll and parallel to the latter. Sheet 10, which arrives at the nip following an earlier stage of the paper-making process, is continuous in length and typically has a relatively large water content. The width of the paper sheet may be as much as 30 feet but may vary depending on the particular requirements of each situation. Endless belt 16 comprising an absorbent felt material also is positioned to pass through the nip between rolls 12 and 14 where it is pressed into contact with paper sheet 10. In a practical embodiment of the invention, the belt may have a thickness on the order of ¼ inch and a width at least equal to that of paper sheet 10. Press roll 12 is driven from a source of rotary power, not shown, at speeds on the order of 3,000 feet per minute. The motion of press roll 12 is imparted to roll 14, as well as to the paper sheet and the belt passing through the nip between these rolls.

In addition to roll 14, a pair of idler rolls 18 and 20, which straddle roll 14 in a manner that limits contact between the belt and the paper to the nip between rolls 12 and 14, are encompassed within the loop of belt 16. The belt loop further encompasses and contacts a felt conditioning roll generally indicated by the reference numeral 24. Guide roll 22 is positioned outside the loop but in contact with the belt and is preferably arranged to be translationally movable so as to provide the capability of varying the wrap angle $\alpha$ of the belt about conditioning roll 24. Further, the mounting of guide roll 22 may include spring biasing means to provide the desired tension in belt 16. Such mounting and biasing means are well known in the art and have been omitted from the drawing for the sake of clarity.

Roll 24 is shown partly exploded in FIG. 1 in order to illustrate its interior. The latter is further shown in schematic illustration in FIG. 2. Roll 24 is hollow and comprises a foraminous, cylindrical shell 26 which comprises of an open-mesh honeycomb structure. The latter may be made from alternate straight and undulating strips of metal arranged edgewise and shaped to define outer and inner cylindrical surfaces. In a preferred embodiment of the invention, the total open area of the foraminous shell exceeds the total land area thereof and may range from approximately 50 to 90 percent of the total shell area. Examples of the type of construction that may be used are disclosed in Bryand U.S. Pat. Nos. 3,100,928; 3,259,961; and 3,590,453.

Opposite ends of cylindrical shell 26 are closed by annular end members or plates 28, only one of which is shown in FIG. 1 for the sake of clarity. Air under pressure is provided by a compressor, not shown, and is introduced to the interior of roll 24 through at least one and preferably a pair of coaxial cylindrical support shafts such as hollow tubes or conduits 30, which may include a portion of flexible tubing 32 to allow for relative positioning of the respective parts. Each conduit 30 which is fixedly mounted on a frame (not shown) extends axially through and somewhat beyond the respective end plate 28 and is journaled relative to the latter by bearing 31, e.g. in the manner shown in the aforesaid Bryand U.S. Pat. No. 3,259,961. Bearing 31 so provided permits rotation of roll 24 about its axis.

An imperforate wall 34 in the form of a section of a cylinder is fixedly mounted on the respective ends of conduits 30 which extend through plates 28 so as to be coaxially positioned internally of roll 24 with the convex side of wall 34 being uniformly spaced from the interior surface defined by shell 26. Wall 34 extends the full length of roll 24 between the end plates and being fixedly mounted on conduits 30 is therefore stationary with respect to shell 26. The long edges of wall 34 terminate in a pair of radial flanges 38 substantially parallel to the long axis of roll 24. Flanges 38 preferably are formed of a resilient material and bear against the interior surface of rotatable shell 26 so as to make a substantially pneumatic-sealing contact therewith.

The concave side of stationary wall 34 opens onto a portion of shell 26 which forms a cylindrical section generally designated by the reference numeral 40. The limits of shell portion 40 are defined by an angle $\beta$ which is subtended by radial flanges 38. It will be understood that angle $\beta$ is positionally constant. Thus, when shell 26 rotates, shell portion 40 designates a positionally constant, though changing, portion of the shell. As seen from FIG. 2, roll 22 is preferably adjusted so that angle $\beta$ is symmetrically bracketed by wrap angle $\alpha$, the latter being approximately 10% larger than angle $\beta$ in a preferred embodiment of the invention. Both angles are in a common plane orthogonal to the long axis of roll 24.

Wall 34, end plates 28 and shell portion 40 together define a plenum chamber 36 which receives air under pressure directly from conduits 30. Since wall 34 and end plates 28 are imperforate, the only path (except for leakage through imperfect seals) which the pressurized air introduced to chamber 36 can take, leads through the open areas of shell portion 40 and through the belt section in contact with shell portion 40.

A shower pipe 42 is positioned above roll 24, adjacent the arriving belt. The shower pipe runs the full width of belt 16 and includes a series of holes adapted to spray water on the belt before the latter reaches roll 24. An essentially semicylindrical splash pan 44 is positioned below roll 24 and includes a pair of flanges 46 for containing the water spray. Flanges 46 are spaced from roll 24 to permit belt 16 to pass therebetween. Splash pan 44 further includes at least one drain pipe 48.

In operation, paper sheet 10 arrives at the nip between rolls 12 and 14. Belt 16 is pressed into contact with paper sheet 10 and the felt material absorbs moisture and water-borne particles such as clay from the paper. Belt 16 travels around idler roll 20 at the speed imparted to it by press roll 12 and past shower pipe 42 where a spray is applied along the full width of the belt. The spray serves to loosen particles transferred from paper sheet 10 to the belt in the nip between rolls 12 and 14.

Following the shower stage, belt 16 travels around the underside of rotatable conditioning roll 24 in contact with foraminous shell 26. The belt and the roll travel substantially at the same speed in contact with one another for the distance of wrap angle $\alpha$. Tension in the belt is maintained by guide roll 20.

As belt 16 passes through angle $\beta$, the inside of the belt in contact with roll 24 encounters air from plenum chamber 36, applied under pressure through the open areas of shell portion 40. The open-mesh honeycomb construction of the shell assures that air pressure is uniformly applied radially outwardly to most portions of the belt because of the very large open areas of the surface of roll 24.

In a preferred embodiment of the invention, the air pressure is regulated so that the force applied by the air to the inside surface of the belt is just below the force required to lift the belt off the external surface of shell 26. Thus, the air pressure acts not only to prevent the creation of a partial vacuum as water is expelled from the belt, but itself acts as an expellant. The force due to air pressure which is thus applied to belt 16 over the area covered by angle $\beta$, bears a relationship to the radius of shell 26 and must be smaller than the force applied to the belt as a result of the combined action of belt tension and atmospheric pressure. The relationship is approximated by the following realtion:

$$p \simeq T/r;$$

where

P = pressure in plenum chanber 36 in psig,

T = belt tension in pounds per inch of belt width (neglecting belt thickness) and $r$ = radius of roll 24 in inches.

In a preferred embodiment of the invention, P is selected to fall between 80 to 100 percent of T/r.

The thickness of the belt is preferably on the order of ¼ inch, such that air blown against its inside surface readily passes through the belt. The combined action of air blown at the inside surface of the belt, centrifugal force and gravity, causes water and particles carried by the belt to be expelled. The expelled materials are collected in splash pan 44 and are carried off through drain 48.

From the foregoing description, it will be clear that the present invention provides an effective system for conditioning a de-watering felt belt at high belt speeds, which system is simple and economical in construction and which is not destructive of the belt. By using a rotatable roll 24 having a relatively large radius, wear due to friction and bending is minimized and belt life is prolonged. The use of a foraminous shell constituted of largely open areas and wherein any periphery of the shell presents a succession of open areas and land areas, lowers the required capacity of the air compressor. Likewise, the efficiency of the present invention, whereby air pressure is applied only to the area of the belt where centrifugal force and gravity are simultaneously effective, serves to limit the required size of the air compressor and hence the cost of the equipment. By holding the pressure below the point where belt lift-off occurs so as to prevent air from escaping from beneath the belt, a further reduction in the required capacity of the compressor can be carried out.

The improvements effected by the present invention permit the use of equipment at a cost below that of systems in which the belt rides on a film of air, and of systems where a vacuum is used in lieu of positive air pressure. By virtue of its efficiency in applying air pressure, the present invention is not as dependent on the action of centrifugal force to purge the belt than is the case in prior art devices of this type. Accordingly, the radius of the conditioning roll may be increased with the result that the life of the felt belt is extended. In a practical embodiment of the invention, roll 24 may have a radius in the range of 6 to 12 inches, compared to a radius as low as 2 inches in prior art systems in which primary reliance is placed on the action of centrifugal force.

In using, for example, a conditioning roll of the present invention with a 12 inch radius, it will be seen that to obtain the same centrifugal force as with a smaller roll, the velocity of the belt need only be increased slightly because, of course, centrifugal force is proportional to the square of the velocity and to the inverse of the radius. But, the larger radius roll increases the dwell time during which the combined forces of air pressure, centrifugal force and gravity can act to overcome the inertia of the water held in the interstices of the felt structure.

It will be seen also that, for typical belt tensions, e.g. 15 pli, the operative air pressure in roll 24 becomes merely a few pounds, a very inexpensively and easily met requirement.

The system disclosed herein lends itself to various modifications within the broad concepts of the invention itself. For example, the paper may have a width of up to 30 feet, although much smaller widths, e.g. down to 6 feet, are contemplated. Various types of shell construction are possible, provided that the total open area of the shell, at minimum, is greater than the total land area. Further, to assure the uniform application of air to all parts of the belt, each such shell construction must provide a succession of open areas and land areas along a peripheral path around the roll taken anywhere along its length.

Pressurized air may be introduced to the plenum chamber by the use of a single conduit instead of the two conduits illustrated, provided only that the distribution of air within the plenum chamber is uniform. In any such modification, members 28 must remain suitably journaled to permit rotation of roll 24 while wall 34 remains stationary.

The configuration of wall 34 admits of numerous modifications, particularly as the magnitude of angle $\beta$ varies. In a preferred embodiment of the invention, it is contempated that the latter angle remain in the trange from 90° to 180°. Accordingly, the wrap angle, which exceeds the magnitude of angle $\beta$ by approximately 10%, may vary accordingly.

From the foregoing discussion, it will be apparent that numerous variations, modifications and substitutions will now occur to those skilled in the art, all of which fall within the spirit and scope contemplated by the present invention and which are limited only by the scope of the appended claims.

What is claimed is:

1. Apparatus for removing foreign matter from a porous, absorbent felt web, comprising:

a rotatably disposed roll closed at its extremes, said roll including a foraminous cylindrical shell having an axial dimension at least equal to the width of said web;

means for feeding said web at a selected speed under tension around said roll, said feeding means and said roll being positioned with respect to each other to provide an unsupported path portion therebetween for said tensioned web, said web being positioned to move jointly with said roll in contact therewith through a wrap angle of at least 90°;

means for introducing a gas under positive pressure directly to the interior of said roll; and means for limiting the application of said pressurized gas to a positionally constant portion of said rotating shell, said shell portion extending axially substantially the full length of said roll and subtending an angle with the axis of said roll encompassed by said wrap angle.

2. Apparatus as defined in claim 1 and further including means positioned adjacent said path portion for spraying the roll-contacting side of said web with water prior to the arrival of said web at said roll.

3. Apparatus as defined in claim 1 wherein said web comprises an endless loop and said foreign matter consists of water and particles to be expelled from said web.

4. Apparatus as defined in claim 1 wherein said shell portion is centered on the low-point of the web path around said roll.

5. Apparatus as defined in claim 1 wherein said wrap angle substantially symmetrically brackets said subtended angle.

6. Apparatus as defined in claim 5 wherein said wrap angle exceeds said subtended angle by an amount no greater than 10% of the magnitude of said wrap angle.

7. Apparatus as defined in claim 1 wherein the magnitude of said subtended angle is between 90° and 180°.

8. Apparatus as defined in claim 1 wherein the total open area of said foraminous shell exceeds its total land area.

9. Apparatus as defined in claim 1 wherein the total open area of said foraminous shell is in the range of about 50% to about 90% of the total shell area.

10. Apparatus as defined in claim 8 wherein said shell presents a succession of open areas and land areas respectively along any periphery throughout its length.

11. Apparatus as defined in claim 10 wherein said shell comprises an open-mesh honeycomb structure formed by edgewise disposed thin metal strips defining a cylindrical outer surface.

12. Apparatus as defined in claim 1 wherein said cylindrical shell terminates at opposite ends in a pair of desk-shaped end members journaled to permit rotation of said roll, said means for introducing gas under pressure comprising a pressurized air supply, and conduit means for supplying said air through at least one of said journaled end members to the interior of said roll.

13. Apparatus as defined in claim 12 wherein said means for limiting the application of pressurized gas comprises a plenum chamber jointly defined by said end members, by said shell portion, and by a stationary, imperforate wall forming a section of a cylinder and extending substantially the full length of said wall being coaxially disposed inside said roll with its concave side facing said shell portion, said wall terminating in a pair of radial flanges forming seals with said shell, said conduit means extending axially into said plenum chamber.

14. Apparatus as defined in claim 13 wherein each of said flanges comprises means resiliently contacting the interior of said shell throughout its length.

15. Apparatus for removing foreign matter such as liquid and particles from an endless belt loop of absorbent felt, comprising:

a hollow conditioning roll having a substantially horizontal axis, said roll including a cylindrical shell having an axial dimension at least equal to the width of said belt, said shell comprising an open-mesh honeycomb structure wherein the total open area exceeds the total land area;

a pair of disk-shaped end member supporting said cylindrical shell and closing opposite ends thereof, said end members being axially journaled to permit rotation of said roll about its axis;

means for moving said belt under tension around the underside of said roll, said belt being adapted to move jointly in contact with said roll through a wrap angle of at least 90°, said belt moving means and said roll being positioned with respect to each other to provide an unsupported path portion therebetween for said tensioned belt;

a stationary, imperforate wall forming a section of a cylinder extending between said end members, said wll being coaxially positioned inside said roll with its concave side facing said wrap angle;

said wall terminating in a pair of radial flanges making sealing contact with the interior of said rotatable shell and extending the full length of said roll, said flanges defining a portion of said rotatable shell therebetwen symmetrically bracketed by said wrap angle;

said wall forming a plenum chamber together with said shell portion and said end members;

conduit means axially extending into said plenum chamber through at least one of said end members; and a pressurized air supply, and means coupling said pressurized air supply to said conduit means and adapted to apply pressurized air to said belt over the area of said shell portion, the pressure level of said pressurized air being selected so as to be less than the opposing force resulting from said web tension and from ambient atmospheric pressure;

whereby the combined action of pressurized air passing through said shell portion and of centrifugal force expels said foreign matter from successive portions of said belt passing around said roll.

16. Apparatus as defined in claim 15 wherein said shell portion subtends an angle with the axis of said roll having a magnitude in the range of 90° to 180°, said wrap angle exceeding said subtended angle by an amount no greater than 10% of the magnitude of said wrap angle.

17. Apparatus as defined in claim 15 wherein the total open area of said shell is in the range of 50 to 90of the total shell area.

18. Apparatus as defined in claim 15 wherein said flanges comprise strips of resilient material which bear against the interior of said rotatable shell.

19. Apparatus as defined in claim 15 wherein said belt loop is adapted to de-water an elongate sheet of wet paper moving in contact with said belt during aportion of said loop, said means for moving said belt under tension comprising:

a rotatable press roll adapted to be rotated from an external source of rotary power;

a rotatable suction press roll positioned internally of said loop in contact with said press roll, said paper and said belt being adapted to pass under compression through the nip between said last-recited rolls;

a pair of rotatable idler rolls positioned internally of said loop and straddling said suction roll;

a pair of rotatable idler rolls positioned internally of said loop and straddling said suction roll;

a rotatable guide roll positioned in contact with said belt externally of said loop and being disposed for translational movement;

said conditioning roll being positioned internally of said loop in a manner whereby said wrap angle and said belt tension are determined by the selected translational position of said guide roll.

20. Apparatus as defined in claim 19 and further including a shower adapted to spray the full width of the interior side of said belt facing said conditioning roll immediately prior to the arrival of said belt at said conditioning roll.

21. Apparatus as defined in claim 20 and further comprising a substantially semicylindrical splash pan coaxially positioned below said conditioning roll opposite said shell portion, and a drain adapted to empty the contents of said pan.

22. Method of removing foreign matter from a moving porous absorbent felt web, said method comprising the steps of moving said web under tension in contact with a rotatable, substantially cylindrical foraminous surface, said web moving jointly with said surface at a selected speed through a wrap angle of at least 90° of a circular path, and applying a gas at a positive pressure to the concave side of said surface throughout the angle bracketed by said wrap angle, to pass through said durface and said web;

said speed and said gas pressure being selected with respect to the radius of said surface so that the combined action of said gas passing through said web and the centrifugal force created by the speed of said web moving in contact with said surface, tends to expel foreign matter from successive portions of said web passing through said bracketed angle.

23. Method as defined in claim 22 wherein said gas is applied at a pressure adapted to exert a force on said web over an area defined substantially by said section which is less than the combined force applied by said web tension and ambient atmospheric pressure.

24. Method as defined in claim 22 wherein said gas is applied at a gauge pressure of between 80% and 100% of $T/r$;

where $T$ = the tension of said web in pounds/inch; and $r$ = the radius of said surface in inches.

25. Method as defined in claim 22 wherein said foreign matter is continuously acquired through contact with an elongate paper sheet at a predetermined location displaced from said wrap angle prior to arrival of said web at said wrap angle.

26. Method as defined in claim 22 and further including the step of spraying said web with water prior to its arrival at said section.

* * * * *

UNITED STATES PATENT OFFICE
CERTIFICATE OF CORRECTION

PATENT NO. : 4116762

DATED : September 26, 1978

INVENTOR(S) : Frank J. Gardiner

It is certified that error appears in the above-identified patent and that said Letters Patent are hereby corrected as shown below:

Claim 12, column 8, line 36, delete "desk-" and substitute therefor --disk- --;

Claim 13, column 8, line 46, after "of" insert --said roll--;

Claim 15, column 8, line 63, delete "member" and substitute therefor --members--;

Claim 15, column 9, line 8, delete "wll" and substitute therefor --wall--;

Claim 17, column 9, line 41, delete "90of" and substitute therefor --90% of--;

Claim 19, column 9, line 48, delete "aportion" and substitute therefor --a portion--;

Claim 19, column 10, delete first two lines;

UNITED STATES PATENT AND TRADEMARK OFFICE

CERTIFICATE OF CORRECTION

PATENT NO. : 4,116,762

DATED : September 26, 1978

INVENTOR(S) : Frank J. Gardiner

It is certified that error appears in the above-identified patent and that said Letters Patent are hereby corrected as shown below:

Claim 22, column 10, line 32, delete "said gas pressure" and substitute therefor --the pressure of said gas--;

Claim 26, column 10, line 58, delete "section" and substitute therefor --wrap angle--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*